United States Patent [19]

Stähli

[11] 4,155,376

[45] May 22, 1979

[54] LIFT BRAKE FOR EXHAUST WATER FOR A VERTICAL DRAIN PIPE SYSTEM

[75] Inventor: Paul Stähli, Jona, Switzerland

[73] Assignee: Geberit AG, Jona, Switzerland

[21] Appl. No.: 784,319

[22] Filed: Apr. 4, 1977

[30] Foreign Application Priority Data

Apr. 5, 1976 [CH] Switzerland ..... 4242/76

[51] Int. Cl.[2] ..... F16D 1/02

[52] U.S. Cl. ..... 138/42; 138/37

[58] Field of Search ..... 138/39, 37, 40, 42, 138/44; 137/254

[56] References Cited

U.S. PATENT DOCUMENTS

| | | | |
|---|---|---|---|
| Re. 12,322 | 2/1905 | Dawson | 138/37 |
| 967,895 | 8/1910 | Frederick | 138/37 |
| 1,737,449 | 11/1929 | Booth | 138/37 |
| 1,817,958 | 8/1911 | Zwilgmeyer | 138/37 |

FOREIGN PATENT DOCUMENTS

| | | | |
|---|---|---|---|
| 431640 | 7/1935 | United Kingdom | 138/37 |

*Primary Examiner*—Lenard A. Footland

*Attorney, Agent, or Firm*—Pollock, Vande Sande & Priddy

[57] ABSTRACT

The invention relates to a lift brake for exhaust water capable of installation in a vertical drain pipe system.

2 Claims, 1 Drawing Figure

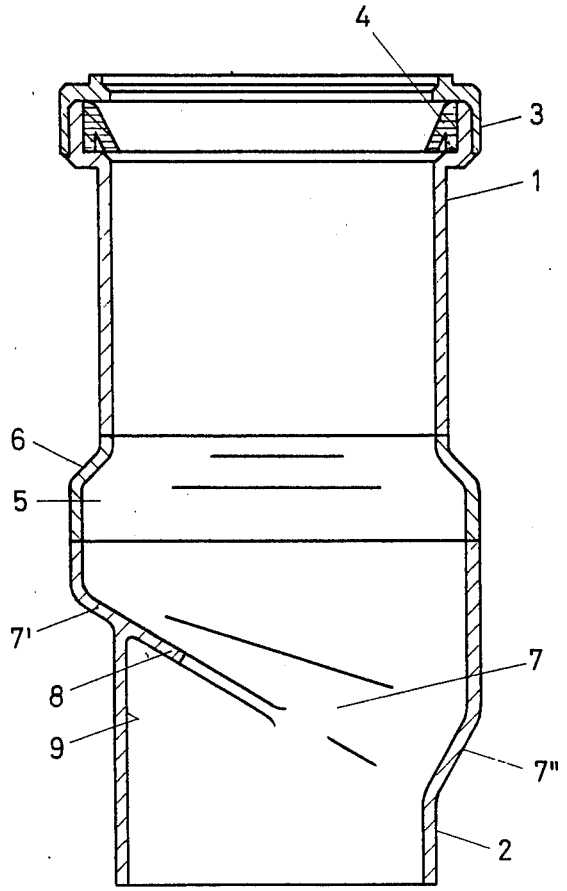
4
3
1
6
5
7'
8
9
7
7"
2

LIFT BRAKE FOR EXHAUST WATER FOR A VERTICAL DRAIN PIPE SYSTEM

BACKGROUND OF THE INVENTION

In the vertical drain pipes of multi-story buildings, the speed of fall of effluent water can become very great, causing a partial vacuum which can lead to the emptying of the siphon drain traps of attached plumbing installations.

To prevent this from occurring, lift brakes have been installed at the lateral attachment location of the drain pipe on each floor, in order to dissipate at least part of the kinetic energy of the water.

For example, the branching members can be provided with water deflecting devices, and with auxiliary connections in the area of the lateral attachments.

Such branching members are naturally complex and expensive to produce, and can be placed only at certain locations in the vertical drain pipe system.

The object of the invention is to overcome these disadvantages and to provide a lift brake which is characterized by a tubular member having a surrounding bulge and a deflecting rib arranged on one side of its inner wall and partly projecting into the interior of the tubular member. According to a preferred embodiment, the deflecting rib has a crescent shape and extends in a diagonally downward direction.

An embodiment of the invention will now be explained in detail with reference to the drawing, which shows a longitudinal section through a lift brake.

The lift brake consists of a vertical tubular member having two connecting portions 1, 2 disposed in vertical alignment with one another. The upper connecting portion has a screw socket 3, known per se, with a seal 4, to connect the tubular member with a corresponding shaped end of a vertical pipe line.

The connection can also be made by means of a welding socket instead of a screw socket, in which case the connecting portion is formed merely as a union, as shown by reference numeral 2.

At its middle portion, the tubular member has a surrounding bulge whose upper termination 6 has an axially symmetrical shape.

The bulge 5 is of differential length over the circumference of the tubular member, the lower end 7 thereof extending diagonally downwardly from its highest point 7', which corresponds to the smallest length of the bulge, continously over the circumferences of the tubular member to its lowest point 7'', the latter location 7'' corresponding to the greatest length of bulge 5.

On the side of the smallest length of the bulge, a diagonally downwardly extending crescent shaped deflecting rib 8 is formed on the inner wall 9 of the tubular member, in such manner that the rib 8 on one side projects partially into the interior of the tubular member.

The lower end 7'' of the bulge beneath rib 8 is located on the side of the tubular member opposite the said rib.

The just described lift brake can be installed at any point in the drain pipe system of a building. In the case of multi-story buildings, lift brakes can be connected to the system on every floor.

The downwardly flowing exhaust water, which practically never completely fills the cross section of the conduit and pulls air along with it, produces a partial vacuum in the drain pipe conduit. When it hits the deflecting rib 8, and because of the bulge 5, a strong turbulance is produced in the lift brake which largely dissipates the kinetic energy of the water, so that the speed of the water immediately below the lift brake is substantially less than immediately above the same.

It has been shown that, when lift brakes are installed on every floor of a multi-story building, the pressure in the drain pipe system never falls to a value which would cause the drain traps to be sucked out of the siphons of toilets and sinks.

What is claimed is:

1. A lift brake for exhaust water for installation in a vertical drain pipe system, comprising a tubular member having a surrounding bulge and a deflecting rib on one side of its inner wall projecting partially into the interior of the tubular member, the bulge having a differential cross-section width over the circumference of the tubular member, the lower end of the bulge extending continuously over the circumference of the tubular member being located on the side of the deflecting rib above the latter and on the opposite side below the latter, whereby, when downwardly flowing water hits said deflecting rib, turbulance is produced and kinetic energy of the water is dissipated.

2. A lift brake according to claim 1, wherein the deflecting rib has a crescent shape and extends diagonally in a downward direction.

* * * * *